United States Patent [19]

Krauss

[11] Patent Number: 4,723,742

[45] Date of Patent: Feb. 9, 1988

[54] SANDBAG SUPPORT

[76] Inventor: Leonard Krauss, 4204 Melisa Ct., Carmichael, Calif. 95608

[21] Appl. No.: 945,684

[22] Filed: Dec. 23, 1986

[51] Int. Cl.[4] ..... A63B 55/04

[52] U.S. Cl. ..... 248/97; 383/33; 493/924

[58] Field of Search ..... 248/95, 97, 99, 101; 383/33; 220/404, 406, 23.6; 53/384; 493/924; 211/71

[56] References Cited

U.S. PATENT DOCUMENTS

| | | | |
|---|---|---|---|
| 513,700 | 1/1894 | Anderson | 248/95 X |
| 669,407 | 3/1901 | Wickman et al. | 248/95 X |
| 805,708 | 11/1905 | Byrd | 248/95 |
| 904,695 | 11/1908 | Herrick | 248/97 |
| 968,349 | 8/1910 | Hanson | 248/97 |
| 1,527,495 | 2/1925 | Torske | 248/95 X |
| 2,896,809 | 7/1959 | Metzger et al. | 220/23.6 X |
| 3,687,408 | 8/1972 | Lake | 248/97 |
| 3,822,524 | 7/1974 | Jerpbak | 53/390 X |
| 3,915,329 | 10/1975 | Zaks | 220/404 |
| 4,037,778 | 7/1977 | Boyle | 248/99 X |
| 4,280,676 | 7/1981 | Betts | 248/97 |
| 4,316,591 | 2/1982 | Muraoka | 206/520 X |
| 4,338,979 | 7/1982 | Dow | 248/97 X |
| 4,407,474 | 10/1983 | Swenson | 248/97 |
| 4,437,634 | 3/1984 | Hambleton | 248/97 |
| 4,534,766 | 8/1985 | Steer et al. | 248/95 X |

*Primary Examiner*—J. Franklin Foss
*Assistant Examiner*—David L. Talbott
*Attorney, Agent, or Firm*—Fleit, Jacobson, Cohn & Price

[57] ABSTRACT

An integral support is provided incorporating a pair of horizontally spaced-apart, horizontally opening and edge upstanding panel member-like U-shaped members. The U-shaped members open in the same horizontal direction and a connecting panel portion extends between adjacent legs of the side-by-side U-shaped members. The free ends of the remote legs of the U-shaped members include hand grip defining openings and the legs of the U-shaped members are divergent toward the free ends thereof.

9 Claims, 5 Drawing Figures

FIG. 1
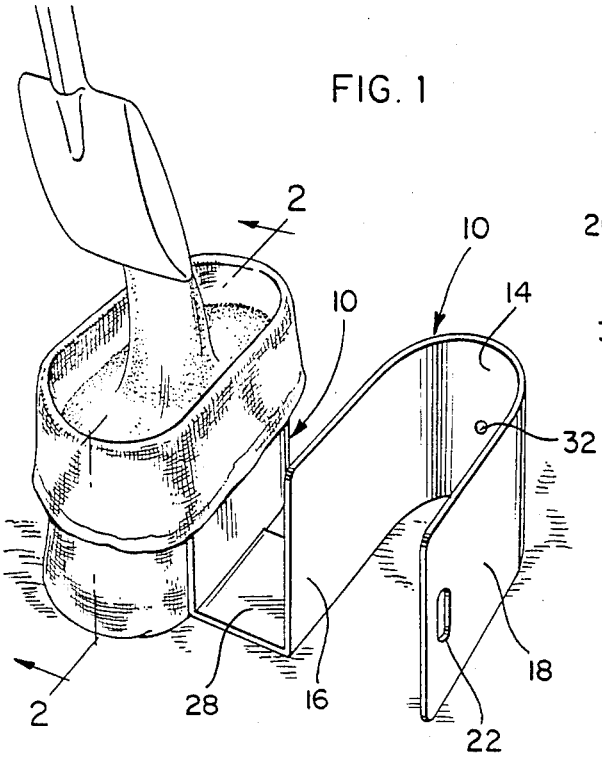
FIG. 3
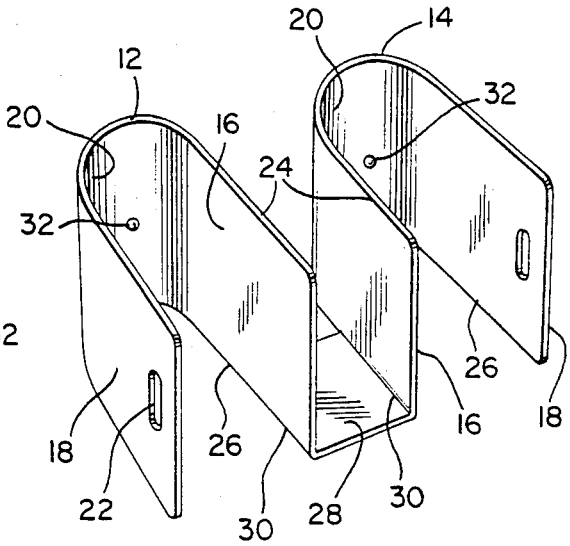
FIG. 2
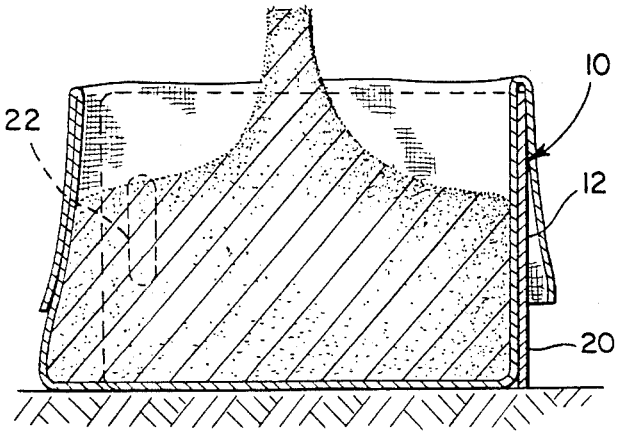
FIG. 5
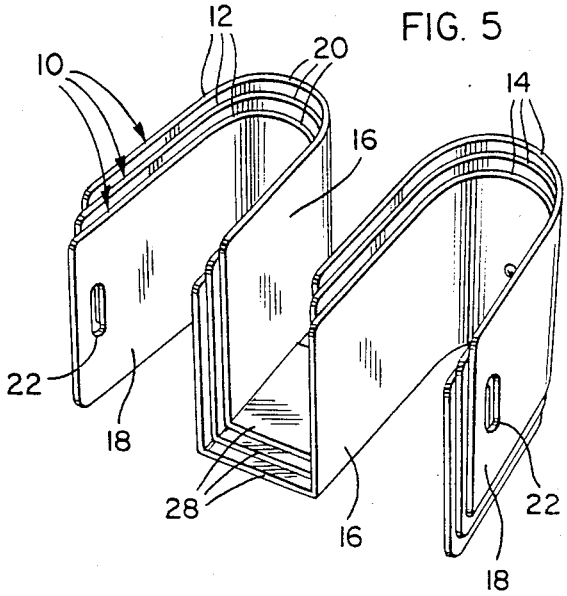
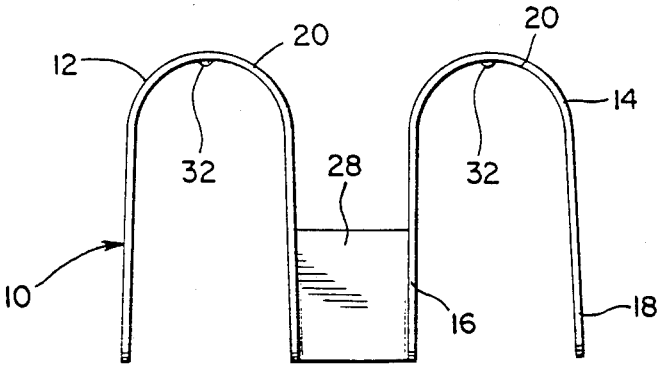
FIG. 4

SANDBAG SUPPORT

BACKGROUND OF THE INVENTION

1. Field of the Invention

This invention relates to a form to be supported from the ground or other suitable horizontal support surface and from which two horizontally spaced apart empty sandbags may be supported for filling the interiors thereof with sand by shovel equipped work persons and without either bag having to be held in an upright position by yet another work person.

2. Description of Related Art

Various different forms of supports including some of the general structural and operational features of the instant invention are disclosed in U.S. Pat. Nos. 3,687,408; 3,822,524, 3,915,329; 4,037,778; 4,280,676; 4,316,591; and 4,338,979. However, these previously known forms of supports do not include the combination of structural features incorporated in the instant invention which enable sandbags to be supported during filling thereof with sand without a person holding the sandbags in an upright open position and without some means being required, in at least some instances, to maintain the sandbag support in stationary upright position.

SUMMARY OF THE INVENTION

The sandbag support of the instant invention incorporates a pair of horizontally spaced apart, horizontally opening, edge upstanding and generally panel-like U-shaped members having generally coplanar upper and lower edges. Horizontally elongated connecting structure extends between and rigidly connects adjacent lower edge portions of the U-shaped members.

The U-shaped members each may support a flexible empty sandbag in upstanding position with the support affording sufficient support to the sandbag to enable the latter to be maintained in upright position while sand is being shoveled or otherwise dispensed thereinto.

The U-shaped members enable a filled sandbag to be readily removed from the support, or the support to be readily removed from about two filled sandbags. In addition, the utilization of a pair of U-shaped members secured together in horizontally spaced-apart relation enables each of the U-shaped members as well as the connecting structure extending there between to afford additional stability to the other U-shaped member. In this manner, the pair of interconnected U-shaped members affords substantially greater stability to each of the associated sandbags being filled than would be provided in the event a single U-shaped member was provided for each sandbag to be filled.

The main object of this invention is to provide a sandbag support to greatly facilitate the proper and rapid filling of sandbags.

Another object of this invention is to provide a sandbag support including structural features thereof enabling the support to be used in filling sandbags while on an incline.

Still another object of this invention is to provide a sandbag support which may be used efficiently by inexperienced persons.

Yet another important of this invention is to provide a sandbag support which may be used efficiently even in adverse weather conditions.

Still another object of this invention is to provide a sandbag support which will facilitate the removal of a filled sandbag therefrom.

Another very important object of this invention, in accordance with the immediately preceding object, is to provide a sandbag support which may be removed from about a filled sandbag.

Another important object of this invention is to provide a sandbag support constructed in a manner such that a large number of sandbag supports may be nested relative to each other for storage and transport.

Yet another important object of this invention is to provide a sandbag support having structural features thereof which facilitate the handling of the support during a sandbag filling operation.

A final object of this invention to be specifically enumerated herein is to provide a sandbag support in accordance with the preceding objects and which will conform to conventional forms of manufacture, be of simple construction and easy to use so as to provide a device that will be economically feasible, longlasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a sandbag support constructed in accordance with the present invention and illustrating a sandbag being filled operatively associated with one of the sandbag supporting portions of the support;

FIG. 2 is an enlarged vertical sectional view taken substantially upon the plane indicated by the sectional line 2—2 of FIG. 1;

FIG. 3 is a perspective view of the support;

FIG. 4 is a top plan view of the support; and

FIG. 5 is a perspective view of a plurality of nested supports;

DESCRIPTION OF THE PREFERRED EMBODIMENTS

Referring now more specifically to the drawings the numeral 10 generally designates the sandbag support of the instant invention. The support 10 includes a pair of horizontally spaced-apart, horizontally opening, edge upstanding and generally panel-like U-shaped members 12 and 14, each including a pair of generally parallel legs 16 and 18 interconnected at corresponding ends by a curved bight portion 20.

The legs 18 have vertically extending openings 22 formed therethrough adjacent their ends remote from the bight portions 20 and the U-shaped members 12 and 14 include generally coplanar upper edges 24 as well as generally planar lower edges 26. A generally horizontal connecting panel 28 extends between and rigidly interconnects the free end portions 30 of the lower edges 26 of the legs 16. Further, each of the bight portions 20 includes an inwardly projecting portion 32 which prevents the supports from tightly wedging together when nested in the manner illustrated in FIG. 5. From FIG. 4, it may be seen that the legs 16 and 18 of each U-shaped member 12 and 14 are slightly divergent toward the free ends thereof remote from the bight portions 20. Accordingly, the supports 10 may be reasonably tightly removably nested for compactness during storage and/or shipment.

The support 10 may be constructed of sheet metal and formed from a single piece of sheet metal. On the other hand, the support 10 may be constructed of durable plastic.

Although a single U-shaped member 12 or 14 could be used to support a sandbag during filling of the same with sand, such a single U-shaped member obviously would not have the stability that is offered by the support 10. A single sandbag supported by only a single U-shaped member could be readily upset with the first shovel full of sand placed within the associated sandbag or any of the first three or four shovel fulls of sand. However, when a pair of support members 12 and 14 are provided, upset of the support 10, even when only one sandbag is being filled, is substantially impossible. Also, the support 10 will provide a stable support for one or two sandbags, even if the support 10 is disposed on an inclined surface. Therefore, the support 10, whether being used to fill two sandbags or only one sandbag provides stable support for the sandbag(s) being filled against upset during the filling operation. This is extremely important when persons filling sandbags are unexperienced, greatly fatigued, working on an incline, working in inclement weather and working at a feverish pace, all of which conditions may exist simultaneously during a flooding averting effort.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A support for sandbags while filling the bags, said support including a pair of horizontally spaced-apart, horizontally opening and edge upstanding panel-like U-shaped members including generally coplanar lower edges, the lower edges of said U-shaped members including adjacent lower edge portions extending generally in the same horizontal directions, and horizontally elongated connecting means extending between and interconnecting said lower edge portions.

2. The support of claim 1, wherein said U-shaped members each include a pair of horizontally extending generally parallel legs having a first pair of corresponding free ends and a second pair of corresponding base ends interconnected by a curved bight portion, said U-shaped members opening in the same generally horizontal direction, the legs of each U-shaped member being slightly divergent toward the free ends thereof.

3. The support of claim 1, wherein each of said U-shaped members includes a pair of generally parallel horizontally extending legs incorporating a first pair corresponding free ends and a second pair of corresponding base ends interconnected by curved bight portion extending and connected therebetween, at least one of the free ends of the legs of each U-shaped member including means defining a hand grip thereon.

4. The support of claim 1, wherein said connecting means comprising a horizontal panel member formed integrally with and extending between said lower edge portions.

5. The support of claim 4, wherein said U-shaped members each include a pair of horizontally extending generally parallel legs having a first pair of corresponding free ends and a second pair of corresponding base ends interconnected by a curved bight portion, said U-shaped members opening in the same generally horizontal direction, the legs of each U-shaped member being slightly divergent toward the free ends thereof.

6. The support of claim 5, wherein at least one of the free ends of the legs of each U-shaped member includes means defining a hand grip thereon.

7. The support of claim 6, wherein a plurality of said supports are nestable relative to each other in a compact state.

8. A support for sandbags while filling the bags, said support including a pair of horizontally spaced-apart, horizontally opening and edge upstanding panel-like U-shaped members, said U-shaped members opening in horizontal directions other than toward each other and including lower edge portions, and horizontally elongated connecting means extending between and connecting adjacent lower edge portions of said U-shaped members.

9. The support of claim 8, wherein said U-shaped members each include a pair of horizontally extending generally parallel legs having a first pair of corresponding free ends and a second pair of corresponding base ends interconnected by a curved bight portion, said U-shaped members opening in the same generally horizontal direction, the legs of each U-shaped member being slightly divergent toward the free ends thereof.

* * * * *